US006315237B1

(12) United States Patent
Hoerner

(10) Patent No.: US 6,315,237 B1
(45) Date of Patent: Nov. 13, 2001

(54) WALL-MOUNTED ROLLED MATERIAL DISPENSING AND STORAGE

(76) Inventor: Darrell Hoerner, P.O. Box 994, Columbia Falls, MT (US) 59912

( * ) Notice: Subject to any disclaimer, the term of this patent is extended or adjusted under 35 U.S.C. 154(b) by 0 days.

(21) Appl. No.: 09/251,385

(22) Filed: Feb. 17, 1999

(51) Int. Cl.[7] ..... B65H 19/00
(52) U.S. Cl. ..... 242/560; 242/598.5; 312/34.22
(58) Field of Search ..... 242/560, 560.2, 242/596.8, 597.8, 598.5; 312/242, 245, 34.1, 34.8, 34.22, 34.24; D6/518, 519, 520, 523, 515; 221/92, 123, 282; 211/86.01, 87.01

(56) References Cited

U.S. PATENT DOCUMENTS

| | | | | |
|---|---|---|---|---|
| D. 249,308 | * | 9/1978 | Williams | D6/520 |
| D. 257,082 | * | 9/1980 | Williams | D6/519 |
| D. 300,703 | * | 4/1989 | Miels | D6/520 X |
| D. 364,059 | * | 11/1995 | Merriweather, Jr. | D6/519 |
| D. 393,972 | * | 5/1998 | Kato | D6/523 |
| 2,576,526 | * | 11/1951 | Marchand | 242/598.5 |
| 3,171,135 | * | 3/1965 | Polichio | 242/598.5 X |
| 3,239,295 | * | 3/1966 | Simon | 242/560 X |
| 3,266,742 | * | 8/1966 | Pena | 242/560 X |
| 3,271,090 | * | 9/1966 | Smithers | 242/560 X |
| 3,279,715 | * | 10/1966 | Vedvig | 242/596.8 X |
| 3,295,900 | * | 1/1967 | Kendall | 242/560.2 X |
| 4,444,359 | * | 4/1984 | Butler . | |
| 5,570,938 | * | 11/1996 | Butler . | |
| 5,597,133 | * | 1/1997 | Teague | 242/560.2 X |

FOREIGN PATENT DOCUMENTS

| | | | | |
|---|---|---|---|---|
| 319170 | * | 3/1957 | (CH) | 242/598.5 |

* cited by examiner

*Primary Examiner*—Donald P. Walsh
*Assistant Examiner*—William A. Rivera
(74) *Attorney, Agent, or Firm*—Anne K. Burkhart; Patrick N. Burkhart

(57) ABSTRACT

A toilet tissue roll dispensing and storage apparatus includes a box member defining an interior volume capable of containing at least one roll of toilet tissue and having at least one opening. The apparatus also includes a door assembly, which has a movable door adapted to selectively cover the opening of the box member. A toilet tissue roll holding and dispensing mechanism is mounted on an exterior surface of the door. The box member is adapted to be mounted on a wall having an interior space and an exterior surface. In an embodiment, the box member can be mounted in the interior space of wall, and the door assembly can be mounted on the exterior surface of the wall. If the wall is of a type constructed of at least two wall studs spaced apart from one another, and the box member can be mounted between the wall studs. The roll holding and dispensing mechanism can include at least one bracket mounted to an exterior surface of the door, with a spindle supported by the bracket. The roll holding and dispensing mechanism is constructed to the roll currently in use in a position substantially entirely outside a plane defined by the exterior surface of the wall. To that end, a recess can be provided in the door adjacent the roll holding and dispensing mechanism, whereby a portion of the roll on the holding mechanism is within the recess. The recess may be provided with a part-cylindrical shape. In order to mount the apparatus, the door assembly can include an outer face frame with a mounting flange corresponding to a peripheral box flange on the box member.

18 Claims, 1 Drawing Sheet

WALL-MOUNTED ROLLED MATERIAL DISPENSING AND STORAGE

FIELD OF THE INVENTION

The present invention relates generally to storing and dispensing rolled materials. Specifically, the present invention relates to unitary devices for simultaneously storing and dispensing toilet tissue.

BACKGROUND OF THE INVENTION

The use and manufacture of toilet tissue predates the widespread acceptance of indoor plumbing. Given the potentially embarrassing and unhygienic consequences of being caught short at inopportune times, it seems likely that the need to store extra quantities of toilet tissue became apparent shortly thereafter.

While the clean cylindrical form of the standard toilet tissue roll is proudly stacked and prominently stored in proximity to many public toilet facilities, its homely form has long been considered aesthetically unacceptable in the bathrooms of most private homes. From dainty crocheted covers to functional polystyrene "caddies", countless approaches have been pursued to subtly and effectively conceal spare rolls from view, while retaining them at hand.

It should not be surprising that many of these approaches have made their way into the patent literature. The following are a few pertinent examples.

U.S. Pat. No. Des. 364,059 to Merriweather is directed to a partition-mounted dual combined seat cover dispenser, toilet paper dispenser, and waste receptacle unit.

U.S. Pat. No. 4,444,359 to Butler sets forth a toilet roll receptacle adaptable for containing and normally concealing a single roll of toilet tissue. U.S. Pat. No. Des. 393,972 to Kato shows an apparently similar device.

U.S. Pat. No. 5,570,938 to Butler is directed to a toilet paper roll holder for storing multiple rolls of toilet paper in a box-like enclosure. The enclosure can be mounted to a wall surface, or in a recess. All of the rolls are stored out of sight and with little danger of environmental contamination.

U.S. Pat. No. Des. 257,082 to Williams shows a combined storage cabinet and paper roll dispenser. Both the storage and dispensing mechanisms are located behind a door.

The above examples show a variety of ways to either store or conceal rolls of toilet tissue. Unfortunately, the devices that provide storage, such as the Butler '938 patent, are relatively large and box-like, rendering them largely unsuitable for home use. On the other hand, the devices having a sleek, decorative appearance, such as those shown in the '359 patent to Butler and the '972 patent to Kato, fail to provide storage for rolls other than the roll in use.

It can thus be seen that the need exists for a toilet tissue storage and dispensing device that provides storage space for additional tissue while maintaining an attractive exterior appearance.

SUMMARY OF THE INVENTION

A toilet tissue roll dispensing and storage apparatus is provided. The apparatus includes a box member defining an interior volume capable of containing at least one roll of toilet tissue and having at least one opening. The apparatus also includes a door assembly, which has a movable door adapted to selectively cover the opening of the box member. A toilet tissue roll holding and dispensing mechanism is mounted on and exterior surface of the door.

The box member is adapted to be mounted on a wall having an interior space and an exterior surface. In an embodiment, the box member can be mounted in the interior space of wall, and the door assembly can be mounted on the exterior surface of the wall. If the wall is of a type constructed of at least two wall studs spaced apart from one another, and the box member can be mounted between the wall studs.

The roll holding and dispensing mechanism can include at least one bracket mounted to an exterior surface of the door, with a spindle supported by the bracket.

The roll holding and dispensing mechanism is constructed to the roll currently in use in a position substantially entirely outside a plane defined by the exterior surface of the wall. To that end, a recess can be provided in the door adjacent the roll holding and dispensing mechanism, whereby a portion of the roll on the holding mechanism is within the recess. The recess may be provided with a part-cylindrical shape.

In order to mount the apparatus, the door assembly can include an outer face frame with a mounting flange. The face frame can be secured coplanar with the exterior of the wall, whereby the box member is secured to the mounting flange. Alternatively, the door assembly can include a basic a door frame mounted between the door and the pre-mounted box member.

A method for assembling a toilet tissue roll dispensing and storage device is also provided. In a first step, a box member is provided that defines an interior space capable of containing at least one roll of toilet tissue and has at least one opening. Next, a movable door is provided. A toilet tissue roll holding and dispensing mechanism is then mounted on the exterior surface of the door. The door is then secured in a position to selectively cover the opening of the box member.

The box member can be installed between interior studs of a wall.

The foregoing will become apparent to one of ordinary skill in the art when taken into consideration with the following detailed description in conjunction with the following drawings, in which:

DETAILED DESCRIPTION OF THE INVENTION

Figure 1:
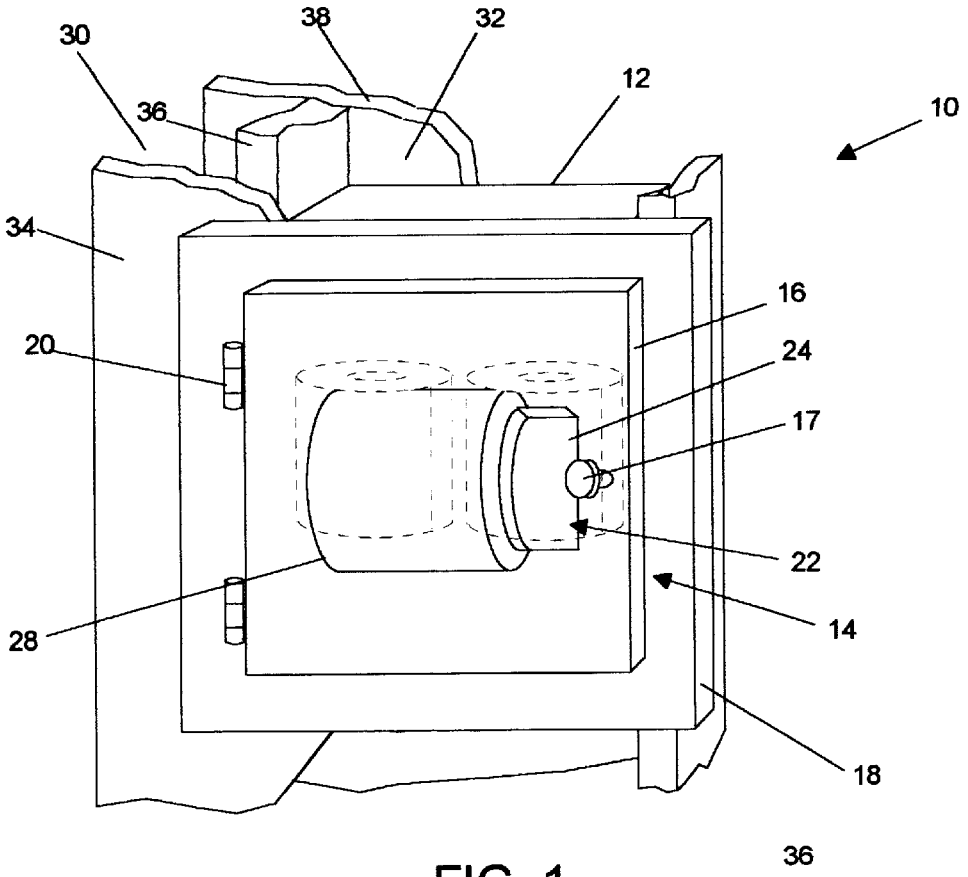
FIG. 1 illustrates a perspective view of a toilet tissue roll dispensing and storage apparatus in accordance with the principles o the present invention.

A toilet tissue roll dispensing and storage apparatus 10 is shown in FIG. 1. The apparatus includes a box member 12 defining an interior volume capable of containing at least one roll of toilet tissue. The apparatus 10 also includes a door assembly 14, which has a movable door 16. The door 16 is selectively movable to permit access to the interior of the box member 12. The door 16 can be provided with a securing mechanism 17, which may be a locking closure or a simple latch. The door 16 is secured to an outer face frame 18 by a suitable movable connection mechanism 20, here illustrated as hinges.

A toilet tissue roll holding and dispensing mechanism 22 is mounted on an exterior surface of the door 16. The roll holding and dispensing mechanism 22 includes a pair of brackets 24 and a spindle 26 (FIG. 2) upon which a roll 28 of toilet tissue is held for dispensing.

The roll dispensing and storage apparatus 10 is adapted to be mounted on a wall 30 having an interior space 32 and an exterior surface 34. The box member 12 can be mounted in the interior space 32, while the door assembly 14 can be mounted on the exterior surface 34 of the wall. The wall 30 is of a type constructed of at least two wall studs 36 spaced apart from one another and supporting a front wall including the exterior surface 34 and a rear wall 38. The box member can be mounted between the wall studs 36.

Figure 2:
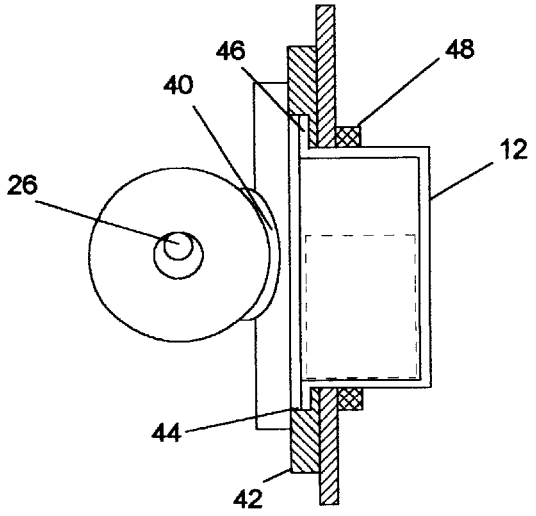
FIG. 2 illustrates a schematic sectional view taken generally along lines II—II of FIG. 1.

As seen in FIG. 2, the roll holding and dispensing mechanism 22 is constructed to hold the roll 28 currently in use in a position substantially entirely outside a plane defined by the exterior surface 34 of the wall 30. To that end, a recess 40 can be provided in the door 16 adjacent the roll holding and dispensing mechanism 22, whereby a portion of the roll 28 on the holding mechanism 22 is within the recess 40. The recess 40 as illustrated is provided with a part-cylindrical shape to accommodate the roll 28.

In order to mount the apparatus, the door assembly 14 can include an outer face frame 42 with a mounting flange 44. The box member 12 is provided with a peripheral box flange 46 having a size and shape corresponding to that of the mounting flange 44.

Installation of the roll dispensing and storage apparatus 10 shown in FIGS. 1 and 2 is as follows. First, a hole is cut in the wall 30 between the studs 36. The hole should be the same size as the outside diameter of the box member 12. Next, a reinforcing member 48 having a dimension corresponding to the size of the mounting flange 44 is placed around an interior surface of the wall 30. The door assembly 14 is then secured to the exterior of the wall 30 in a suitable manner, for example, by driving a plurality of screws through mounting flange 44 of the face frame 42, the wall surface, and reinforcing member 48. Finally, the box is inserted into the hole, and the box flange 46 is secured to the mounting flange 44 in a suitable manner, for example, by a plurality of screws. In this arrangement, the box flange 46 is "outside" the face frame 42.

Figure 3:
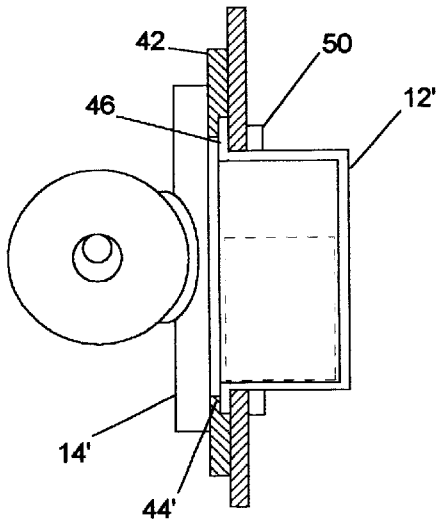
FIG. 3 illustrates a schematic sectional view of an alternative embodiment.

An alternative installation arrangement is shown in FIG. 3, in which the box flange 46' is "inside" the face frame 42. In this arrangement, the box member 12' is secured to a hole in the wall 30' with a plurality of fasteners 50, such as flap-and-screw connectors. With the box member 12' in place, the door assembly 14' is then mounted in position with the mounting flange 44' surrounding the box flange 46'.

The interior volume of the box member 12 is of sufficient size to store at least one extra roll of tissue, shown in broken line in FIGS. 2 and 3. Although the roll dispensing and storage apparatus 10 can be of virtually any dimensions to store and dispense any size or type of rolled material, it has been found that a box member of approximately 9.75 inches by 9.75 inches by 4.625 to 4.875 inches, with a box flange approximately 0.75 inches wide, is particularly advantageous. With a box member of these dimensions, a face frame approximately 13 inches by 13 inches by 0.75 to 0.875 inches, with a 10 inch square opening covered by a door 11.25 inches square, would be suitable.

The roll dispensing and storage apparatus 10 can be made from any suitable materials. For example, the door assembly 14 can be fabricated from a strong, decorative material such as wood or metal to coordinate with other bathroom fixtures. The box member 12 can be made from a suitable strong, lightweight material such as polystyrene.

It is to be understood that the described invention is susceptible to many modifications. For example, the invention could be constructed on a large scale Although the present invention has been described with reference to specific embodiments, those of skill in the art will recognize that changes may be made thereto without departing from the scope and spirit of the invention as defined by the appended claims.

What is claimed is:

1. A toilet tissue roll dispensing and storage apparatus adapted for installation into a wall is constructed of at least two wall studs spaced apart from one another, the apparatus comprising the following:

a box member defining an interior volume capable of containing at least one roll of toilet tissue and having at least one opening;

a door assembly including a movable door adapted to selectively cover the opening of the box member, the door including an exterior surface; and a toilet tissue roll holding and dispensing mechanism mounted on the exterior surface of the door, a recess in the door adjacent the roll holding and dispensing mechanism, wherein the recess in the door does not protrude into the box member defining the interior volume, the interior volume of the box member capable of containing at least one roll of toilet tissue being directly behind the holding and dispensing mechanism.

2. An apparatus according to claim 1, wherein the box member is adapted to be mounted on a wall having an interior space and an exterior surface.

3. An apparatus according to claim 2, wherein the box member is adapted and constructed to be mounted in the interior space of wall, and the door assembly is adapted and constructed to be mounted on the exterior surface of the wall.

4. An apparatus according to claim 3, wherein the box member is adapted and constructed to be mounted between the wall studs.

5. An apparatus according to claim 3, wherein the door assembly further comprises a door frame mounted between the door and the box member.

6. An apparatus according to claim 2, wherein the door assembly further comprises an outer face frame secured coplanar with the exterior of the wall, the outer face frame including a mounting flange;

whereby the box member is secured to the mounting flange.

7. An apparatus according to claim 1, wherein the roll holding and dispensing mechanism comprises the following:

at least one bracket mounted to an exterior surface of the door; and a spindle supported by the at least one bracket.

8. An apparatus according to claim 1, wherein the roll holding and dispensing mechanism is adapted and constructed to hold a roll on the holding mechanism such that the roll is substantially entirely outside a plane defined by the exterior surface of the wall.

9. An apparatus according to claim 1, wherein the recess in the door comprises a part-cylindrical recess.

10. An apparatus for dispensing and storing rolled sheet material, the apparatus being adapted for mounting on a wall having an interior space constructed of at least two wall studs spaced apart from one another and a substantially planar exterior surface, the apparatus comprising the following:

a storage unit including a storage space disposed within the in the interior space of the wall and behind the exterior surface of the wall, the storage space being adapted to contain at least one unit of rolled material; and a closure member adapted to move selectively between a closed position, substantially parallel to the wall exterior surface, covering the storage space and an open position permitting access to the storage space; and a roll holding mechanism disposed on an exterior surface of the closure member of the storage unit, a recess in the closure member adjacent the roll holding mechanism, wherein the recess in the door does not protrude into the storage unit including the storage space, the storage space adapted to contain at least one unit of rolled material being directly behind the roll holding mechanism;

whereby the apparatus is capable of simultaneously storing a first roll of material in the storage space and holding a second roll of material on the roll holding mechanism.

11. An apparatus according to claim 10, wherein the storage unit comprises a box member adapted and constructed to be mounted between the wall studs.

12. An apparatus according to claim 11, wherein the closure member further comprises an outer face frame secured coplanar with the exterior of the wall, the outer face frame including a mounting flange; and whereby the storage unit is secured to the mounting flange.

13. An apparatus according to claim 10, wherein the roll holding mechanism comprises the following:

at least one bracket mounted to an exterior surface of the closure member; and a spindle supported by the at least one bracket.

14. An apparatus according to claim 13, further comprising a frame mounted between the closure member and the storage unit.

15. An apparatus according to claim 10, wherein the roll holding mechanism is adapted and constructed to hold a roll such that the roll is substantially entirely outside a plane defined by the exterior surface of the wall.

16. An apparatus according to claim 10, wherein the recess in the closure member comprises a part-cylindrical recess.

17. A method for assembling a toilet tissue roll dispensing and storage device, the method comprising the following steps:

providing a box member defining an interior space capable of containing at least one roll of toilet tissue and having at least one opening;

providing a movable door including an exterior surface;

mounting a toilet tissue roll holding and dispensing mechanism on the exterior surface of the door;

providing a recess in the movable door adjacent the roll holding and dispensing mechanism, wherein the recess in the door does not protrude into the box member defining the interior space; and securing the door in a position to selectively cover the opening of the box member such that the box member is capable of containing at least one roll of toilet tissue directly behind the holding and dispensing mechanism.

18. A method according to claim 17, further comprising the step of installing the box member between interior studs of a wall.

* * * * *